US008183488B2

(12) United States Patent
Spitsberg et al.

(10) Patent No.: US 8,183,488 B2
(45) Date of Patent: May 22, 2012

(54) ELECTRICAL SWITCHING APPARATUS AND LOAD CONDUCTOR THEREFOR

(75) Inventors: Yuri C. Spitsberg, Pittsburgh, PA (US); Andrew L. Gottschalk, Pittsburgh, PA (US); Brian J. Schaltenbrand, Pittsburgh, PA (US); Mark A. Janusek, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 372 days.

(21) Appl. No.: 12/559,779

(22) Filed: Sep. 15, 2009

(65) Prior Publication Data

US 2011/0062004 A1 Mar. 17, 2011

(51) Int. Cl.
*H01H 23/00* (2006.01)

(52) U.S. Cl. ..... 200/401; 200/284

(58) Field of Classification Search ..... 200/401, 200/400, 284, 293–294, 296, 307; 335/202
See application file for complete search history.

(56) References Cited

U.S. PATENT DOCUMENTS

| | | | | |
|---|---|---|---|---|
| 4,267,417 | A * | 5/1981 | Koepke | 200/512 |
| 6,337,613 | B1 * | 1/2002 | Grelier et al. | 335/8 |
| 6,380,830 | B1 * | 4/2002 | Dahl et al. | 335/68 |
| 6,864,768 | B2 * | 3/2005 | Passow et al. | 335/132 |
| 7,351,927 | B1 | 4/2008 | Rakus et al. | |
| 7,474,179 | B2 | 1/2009 | Weister et al. | |
| 7,518,074 | B2 | 4/2009 | Weister et al. | |
| 7,569,784 | B2 | 8/2009 | Rakus et al. | |

* cited by examiner

*Primary Examiner* — Xuong Chung Trans
(74) *Attorney, Agent, or Firm* — John A. Kastelic; Martin J. Moran; Kirk D. Houser

(57) ABSTRACT

A load conductor is provided for an electrical switching apparatus, such as a circuit breaker. The circuit breaker includes a housing having a number of recesses. The load conductor includes first and second opposing sides, an intermediate portion extending between the first and second sides, and a number of protrusions extending outwardly from the second side. Each of the protrusions is disposed within a corresponding one of the recesses of the housing to secure the load conductor without a separate fastener.

20 Claims, 5 Drawing Sheets

100

ELECTRICAL SWITCHING APPARATUS AND LOAD CONDUCTOR THEREFOR

BACKGROUND

1. Field

The disclosed concept relates generally to electrical switching apparatus and, in particular, to electrical switching apparatus, such as circuit breakers. The disclosed concept further relates to load conductors for circuit breakers.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions.

FIGS. 1, 2A and 2B, for example, show a circuit breaker 1 including a molded housing 3 (partially shown). The operating mechanism 5 is enclosed by the housing 3, and includes a pivotal poleshaft 7 (FIG. 2B) structured to open and close electrical contact assemblies 9, which are also disposed within the molded housing 3. The electrical contact assemblies 9 generally comprise a conductor assembly 11 including a movable contact assembly 13 having a plurality of movable contacts 15 (one movable contact 15 is shown in FIG. 2B), and a stationary contact assembly 17 having a plurality of corresponding stationary contacts 19 (one stationary contact 19 is shown in FIG. 2B). The movable contact assembly 13 is electrically connected to a generally rigid conductor 21 (e.g., load conductor) of the conductor assembly 11 by flexible conductors, commonly referred to as shunts 23 (FIG. 2B).

A mounting hardware assembly 25 mounts the load conductor 21 within the circuit breaker housing 3. That is, a plurality of fasteners (see, for example, fasteners 27,29,31, 33,35 all shown in FIG. 1) must be assembled and fastened in order to fasten (e.g., secure) the load conductor 21 with respect to a desired portion 37 of the circuit breaker 1. In the non-limiting example of FIGS. 1, 2A and 2B, the mounting hardware assembly 25 includes a bolt 27, first and second washers 29,31 (both shown in FIG. 1), sleeves 33 and nut plates 35. The nut plates 35 are sized and configured to be disposed within corresponding recesses 37 of the circuit breaker housing 3, as shown in FIGS. 2A and 2B. Thus, the bolts 27 are inserted through the load conductor 21 and sleeves 33 and are fastened (e.g., tightened) to the nut plates 35 within the recesses 37 to secure the load conductor 21 to the housing 3.

There is room for improvement in electrical switching apparatus, and in load conductors therefor.

SUMMARY

These needs and others are met by embodiments of the disclosed concept, which are directed to a load conductor for an electrical switching apparatus, such as a circuit breaker, wherein the load conductor is coupled to the circuit breaker without requiring a number of separate fasteners.

As one aspect of the disclosed concept, a load conductor is provided for an electrical switching apparatus. The electrical switching apparatus includes a housing comprising a number of recesses. The load conductor comprises: a first side; a second side disposed opposite and distal from the first side; an intermediate portion extending between the first side and the second side; and a number of protrusions extending outwardly from the second side, each of the protrusions being structured to be disposed within a corresponding one of the recesses of the housing to secure the load conductor without a separate fastener.

Each of the protrusions may comprise a first portion and a second portion extending outwardly from the first portion. The first portion may be a first substantially straight segment including a first end, a second end disposed opposite and distal from the first end, and an intermediate portion extending between the first end and the second end, and the second portion may be a second substantially straight segment. The second substantially straight segment may extend perpendicularly outwardly from the intermediate portion of the first substantially straight segment.

The number of protrusions may be a first T-shaped protrusion and a second T-shaped protrusion, and the number of recesses of the housing may be a first recess and a second recess. The first T-shaped protrusion may be structured to be substantially disposed within the first recess, and the second T-shaped protrusion may be structured to be substantially disposed within the second recess.

As another aspect of the disclosed concept, an electrical switching apparatus comprises: a housing comprising a number of recesses; and at least one load conductor comprising: a first side, a second side disposed opposite and distal from the first side, an intermediate portion extending between the first side and the second side, and a number of protrusions extending outwardly from the second side, each of the protrusions being disposed within a corresponding one of the recesses of the housing to secure the at least one load conductor without a separate fastener.

The electrical switching apparatus may be a circuit breaker, wherein the circuit breaker includes a plurality of poles, and wherein the at least one load conductor is a plurality of load conductors, one for each pole of the circuit breaker.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "fastener" shall mean a separate element or elements which is/are employed to tighten two or more components together, and expressly includes but is not limited to, screws, bolts and the combinations of bolts and nuts (e.g., without limitation, lock nuts) and bolts, washers and nuts.

As employed herein, the terms "contiguous" shall mean that one component, portion or segment is immediately adjacent to or in an abutting relationship with another component, portion or segment, in order that the two components are touching along a boundary or point.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 3:
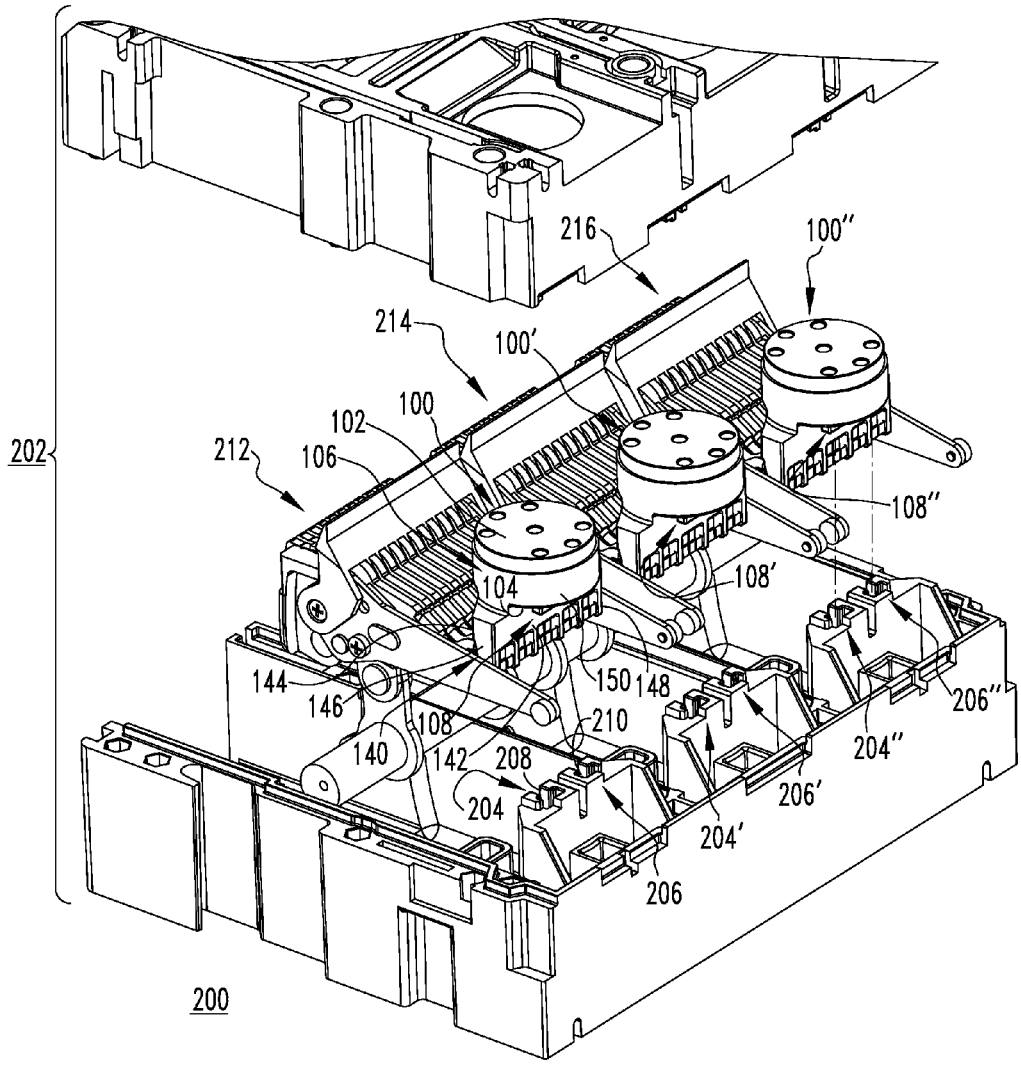
FIG. 3 is an isometric partially exploded view of a portion of a circuit breaker and a number of load conductors therefor, in accordance with an embodiment of the disclosed concept.

FIG. 3 shows a load conductor 100 for an electrical switching apparatus, such as for example and without limitation, a circuit breaker 200 (partially shown). In the example of FIG. 3, the circuit breaker 200 includes three poles 212,214,216 and three load conductors 100,100',100", one for each pole 212,214,216, respectively. It will, however, be appreciated that any known or suitable number and/or configuration of load conductors 100,100',100" could be employed with any known or suitable alternative electrical switching apparatus (not shown) having any known or suitable number and/or configuration of poles.

The circuit breaker 200 includes a housing 202 (partially shown in exploded view in FIG. 3) including a number of recesses 204,206 (see also recesses 204',206' of pole 214, and recesses 204",206" of pole 216). For economy of disclosure, only one of the load conductors 100 will be described in detail herein. It will be appreciated that the other load conductors 100',100" are substantially similar. Specifically, each load conductor 100 includes first and second opposing sides 102, 104 and an intermediate portion 106 extending therebetween.

Figure 1:
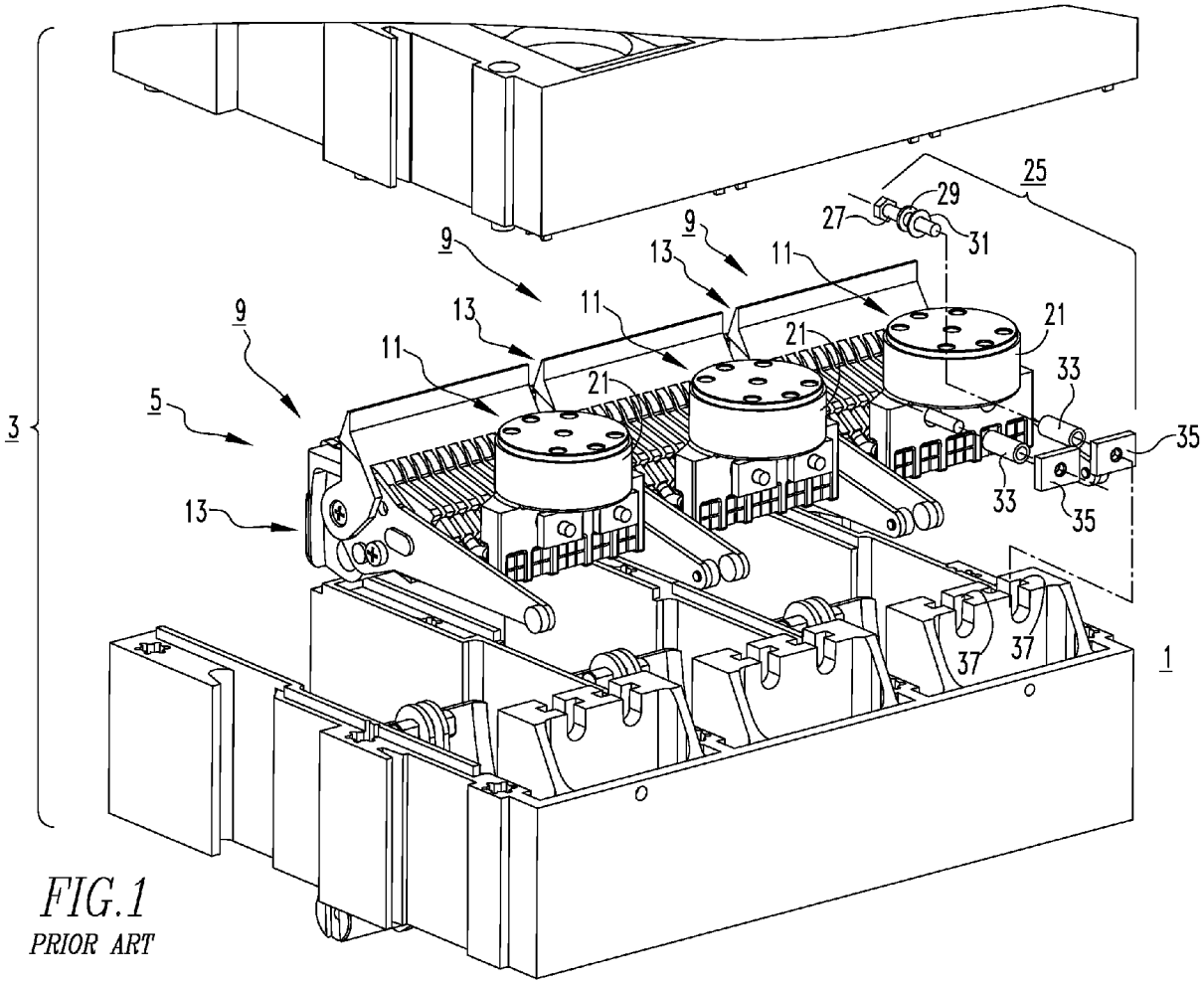
FIG.1 PRIOR ART
FIG. 1 is an isometric partially exploded view of a portion of a circuit breaker and a plurality of load conductor assemblies therefor.
Figure 2B:
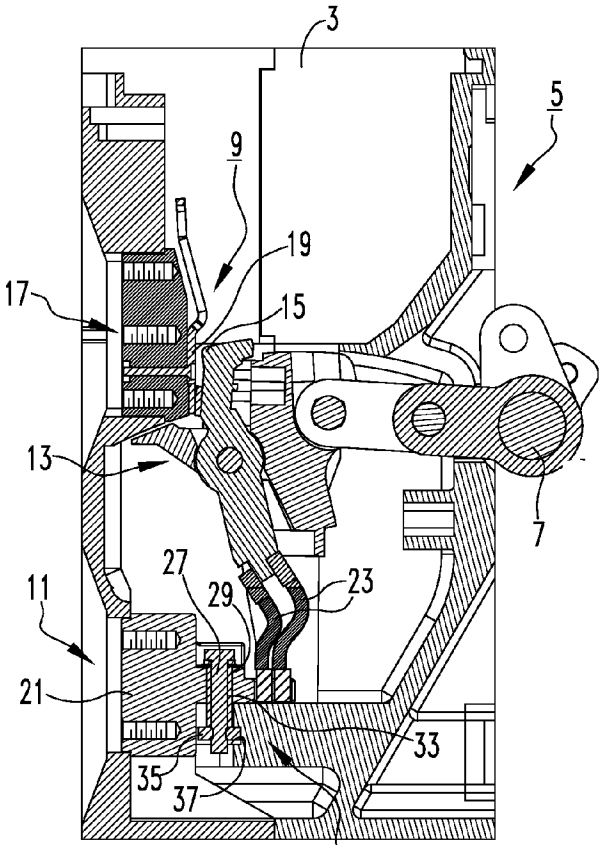
FIG. 2B PRIOR ART
FIG. 2B is a section view taken along line 2B-2B of FIG. 2A.
Figure 2A:
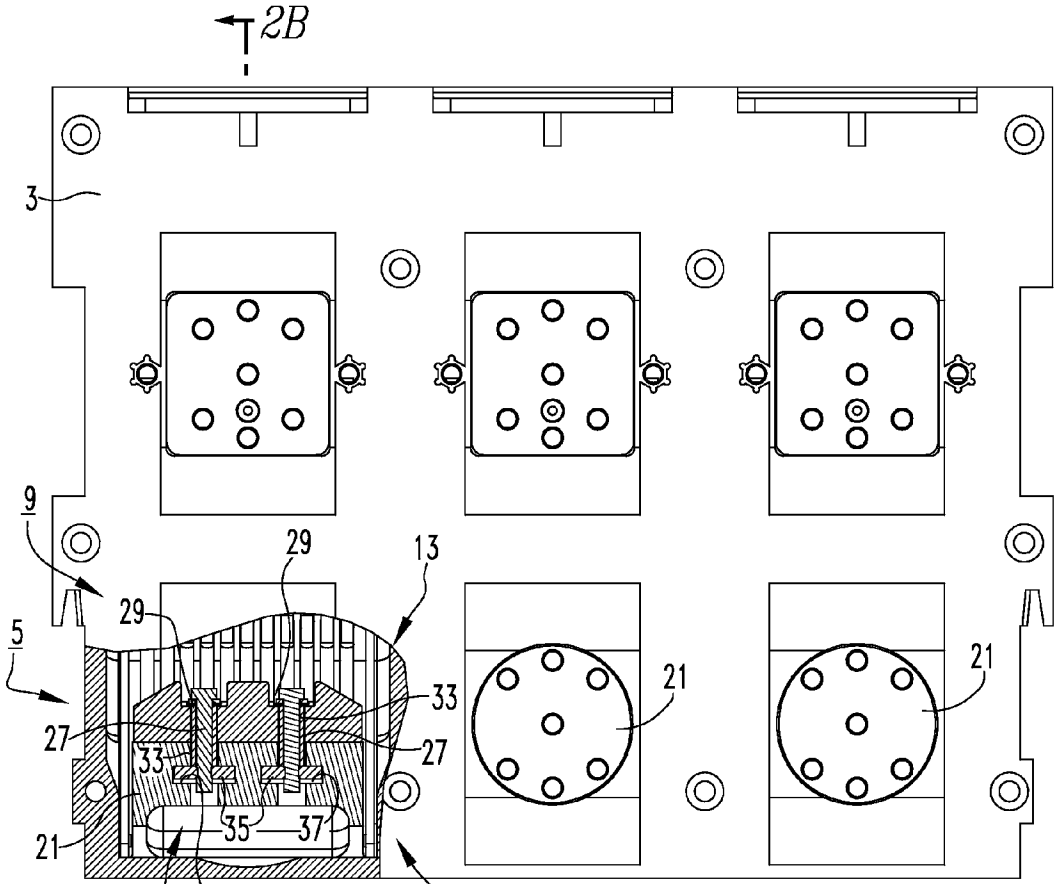
FIG. 2A PRIOR ART
FIG. 2A is a top plan partially in section view of the circuit breaker and load conductor assemblies therefor of FIG. 1.
Figure 4:
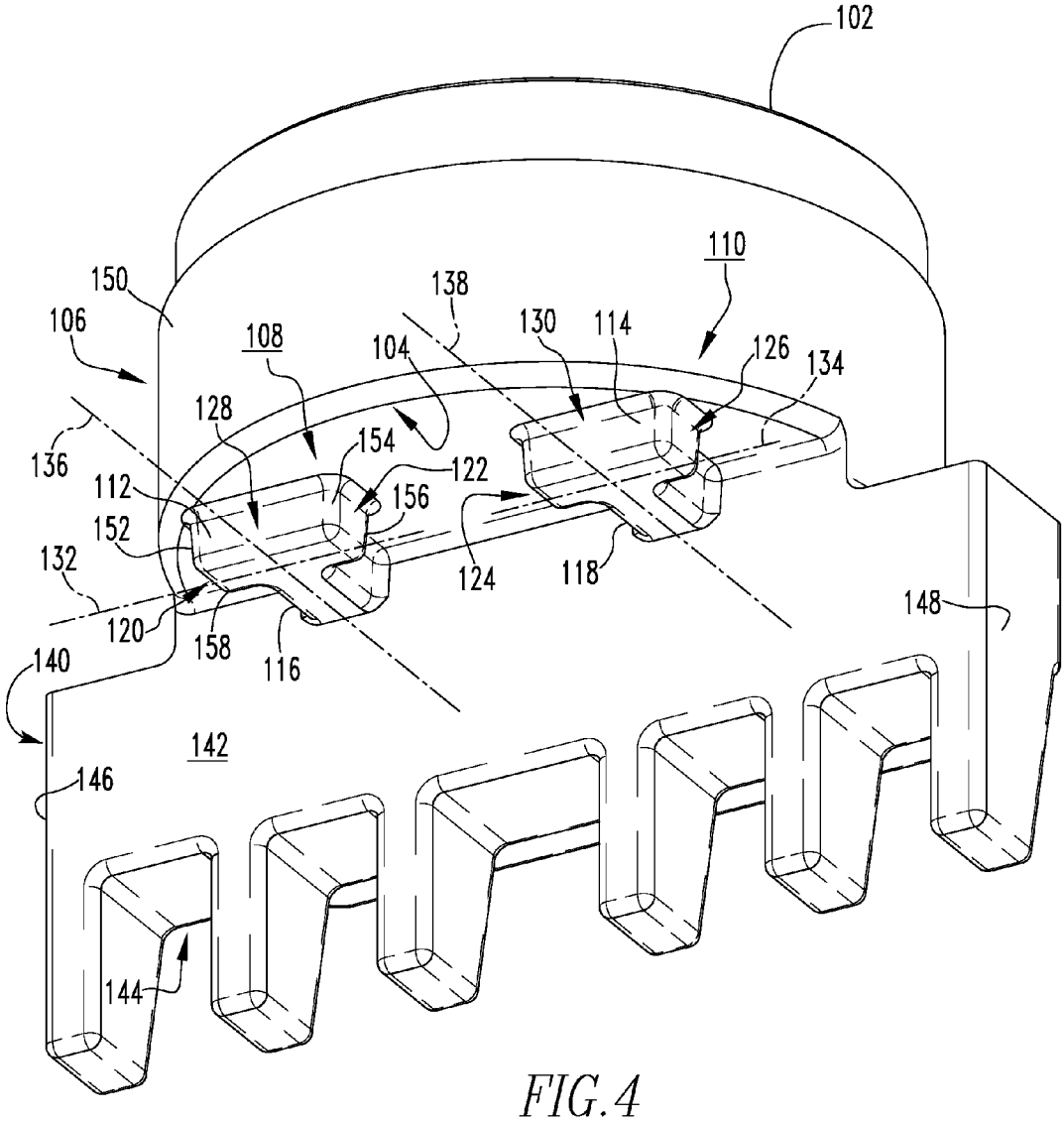
FIG. 4 is an isometric view of one of the load conductors of FIG. 3.
Figure 5B:
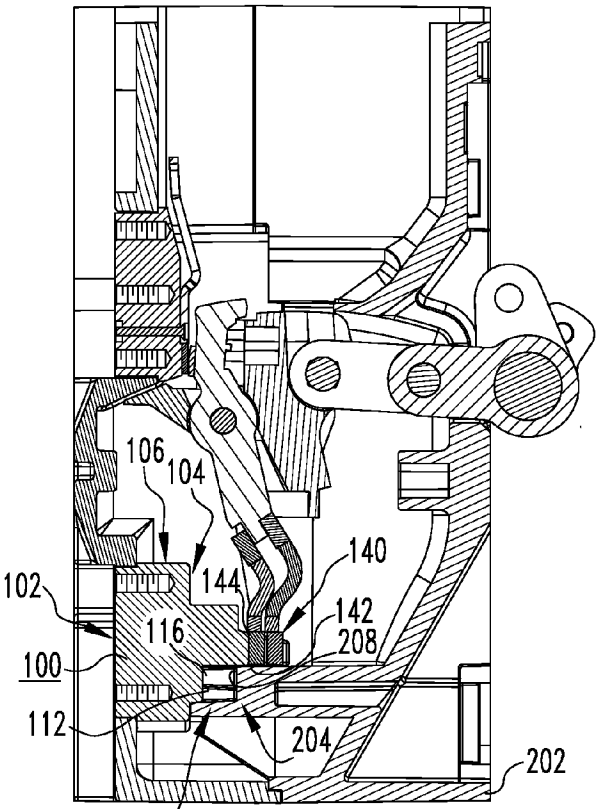
FIG. 5B is a section view taken along line 5B-5B of FIG. 2A.
Figure 5A:
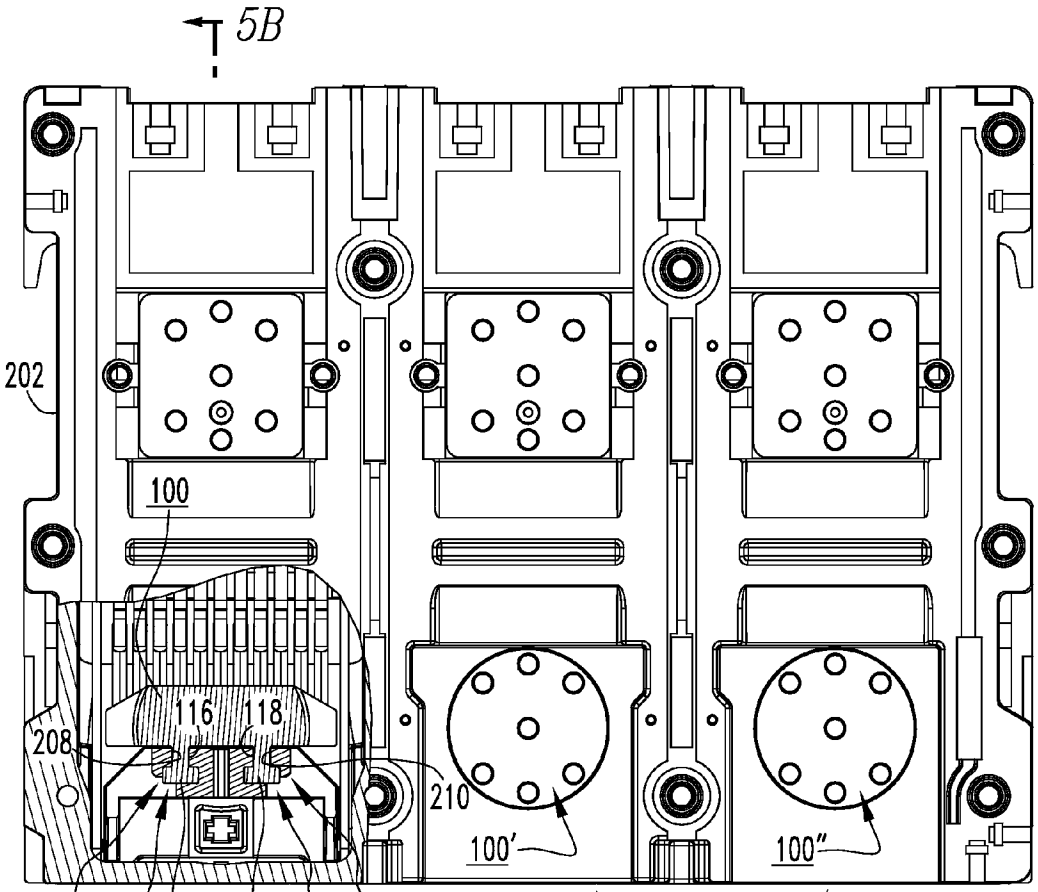
FIG. 5A is a top plan partially in section view of the circuit breaker and load conductors therefor of FIG. 3.

As shown in the non-limiting example of FIG. 4, a number of protrusions 108,110 extend outwardly from the second side 104 of the load conductor 100. The protrusions 108,110 are structured to be disposed within corresponding recesses 204,206, respectively, of the circuit breaker housing 202, as shown in FIG. 5A, to secure the load conductor 100 within the circuit beaker 200, without requiring the use of a separate fastener or plurality of fasteners. It will, therefore, be appreciated that the disclosed load conductor (e.g., without limitation, 100, 100', 100" (all shown in FIG. 3)) advantageously eliminates the need for separate hardware (e.g., without limitation, fasteners) to secure the load conductor to the corresponding recess (e.g., without limitation, 204,206; 204'206'; 204",206") of the circuit breaker housing 202 that is required by known load conductors (see, for example, mounting hardware assembly 25 and bolt 27, washer 29, washer 31, sleeve 33 and nut plate 35 therefor, which is required to secure the load conductor 21 of FIGS. 1-2B to the circuit breaker housing 3). Among other benefits, eliminating the use of such fasteners avoids time-consuming assembly and difficult access to the fasteners within the relatively small interior of the circuit breaker housing. It also reduces the overall number of parts of the electrical switching apparatus, thereby advantageously reducing manufacturing costs. One non-limiting example of a protrusion design in accordance with the disclosed concept, which enables the elimination of such fasteners, will now be described in greater detail.

Specifically, as best shown in FIG. 4, the example load conductor 100 includes first and second T-shaped protrusions 108,110, although it will be appreciated that any known or suitable alternative number, shape and/or configuration of protrusions (not shown) could be employed, without departing from the scope of the disclosed concept. For example and without limitation, although two T-shaped protrusions 108, 110 are shown and described herein, one single relatively large protrusion (not shown) could be employed.

Each of the example protrusions 108,110 respectively includes a first portion 112,114 and a second portion 116,118 extending outwardly from the first portion 112,114. In the example of FIG. 4, the first T-shaped protrusion 108 includes a substantially straight segment 112 having first and second opposing ends 120,122, and the second T-shaped protrusion 110 includes a first substantially straight segment 114 having first and second opposing ends 124,126. The first substantially straight segments 112,114 further include an intermediate protrusion 128,130, respectively. The second portion of each T-shaped protrusion 108,110 is a second substantially straight segment 116,118, respectively. Specifically, the second substantially straight segment 116 of the first T-shaped protrusion extends perpendicularly outwardly from the intermediate portion 128 of the first substantially straight segment 112 thereof. Similarly, the second substantially straight segment 118 of the second T-shaped protrusion 110 extends perpendicularly outwardly from the intermediate portion 130 of the first substantially straight segment 114 thereof. Thus, as previously discussed, it will be appreciated that the protrusions 108,110 of the example load conductor 100 are generally T-shaped, as best shown in FIGS. 4 and 5A.

As shown in FIGS. 3 and 5A, the circuit breaker housing 202 further includes a first channel 208 extending outwardly from the first recess 204, and a second channel 210 extending outwardly from the second recess 206. Accordingly, as best shown in FIG. 5A, when the load conductor 100 is assembled within the housing 202, the first substantially straight segment 112 of the first T-shaped protrusion 108 is disposed in the first recess 204, and the second substantially straight segment 116 of the first T-shaped protrusion 108 is disposed in a first channel 208. Similarly, the first substantially straight segment 114 of the second T-shaped protrusion 110 is disposed in the second recess 206, and the second substantially straight segment 118 of the second T-shaped protrusion 110 is disposed in the second channel 210. In this manner, the protrusion and recess interface between the load conductor 100 and circuit breaker housing 202, respectively, establish and maintain a secure fit of the load conductor 100 within the housing 202, without requiring a separate fastener or plurality of fasteners.

Referring again to FIG. 4, the first substantially straight segment 112 of the first T-shaped protrusion 108 includes a longitudinal axis 132, which is preferably aligned with a corresponding longitudinal axis 134 of the first substantially straight segment 114 of the second T-shaped protrusion 110. Additionally, the second substantially straight segment 118 has a longitudinal axis 136, which is preferably parallel with respect to a corresponding longitudinal axis 138 of the second substantially straight segment 118 of the second T-shaped protrusion 110, as shown. It will also be appreciated that the plurality of protrusions 108,110 (two T-shaped protrusions 108,110 are shown) are preferably, although not necessarily, substantially identical.

As shown in FIG. 4, a projection 140 projects generally perpendicularly outwardly from the second side 104 of the load conductor 100. The projection 140 includes first and second opposing sides 142,144 and first and second opposing edges 146,148. The second substantially straight segment 116 of the first T-shaped protrusion 108 extends outwardly from the first side 142 of the projection 140 between the first side 142 of the projection 140 and the second substantially straight segment 116 of the first T-shaped protrusion 108, as shown. Similarly, the second substantially straight segment 118 of the second T-shaped protrusion 110 extends outwardly from the first side 142 of the projection 140 between the first side 142 of the projection 140 and the second substantially straight segment 118 of the second T-shaped protrusion 110. The second side 104 of the example load conductor 100 has a circular perimeter (indicated generally by reference 150 in FIG. 4). The aforementioned projection 140 extends laterally across the second side 104 of the load conductor 100 such that the first and second edges 146,148 of the projection 140 extend beyond the circular perimeter 150 in opposing directions, as shown. It will be noted, however, that preferably, no portion of either of the protrusions 108,110 extends beyond the circular perimeter 150 of the load conductor 100. More specifically, in the example of FIG. 4, the first substantially straight segment is a substantially rectangular segment 112 including a plurality of corners 152,154,156,158. A corresponding one of the corners 152 is contiguous with the circular perimeter 150 of the load conductor 100, as shown. It will, however, be appreciated that any known or suitable alternative number, type and/or shape or configuration of protrusions other than those shown and described herein, could be employed, without departing from the scope of the disclosed concept.

Accordingly, it will be appreciated that the disclosed protrusions 108,110 (both shown in FIGS. 4 and 5A) provide a unique mechanism for effectively and efficiently securing the load conductor(s) 100,100', 100" (all shown in FIGS. 3 and 5A) to a corresponding portion (e.g., without limitation, recesses 204,206; 204',206'; 204",206" (all shown in FIG. 3)) of the circuit breaker housing 202, without a number of separate fasteners. This advantageously reduces the number of parts of the circuit breaker 200, simplifies the assembly of the circuit breaker 200, and reduces the cost of the circuit breaker 200.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A load conductor for an electrical switching apparatus, said electrical switching apparatus including a housing comprising a number of recesses, said load conductor comprising:
- a first side;
- a second side disposed opposite and distal from the first side;
- an intermediate portion extending between the first side and the second side; and
- a number of protrusions extending outwardly from the second side, each of said protrusions being structured to be disposed within a corresponding one of said recesses of the housing to secure said load conductor without a separate fastener.

2. The load conductor of claim 1 wherein each of said protrusions comprises a first portion and a second portion extending outwardly from the first portion.

3. The load conductor of claim 2 wherein said first portion is a first substantially straight segment including a first end, a second end disposed opposite and distal from the first end, and an intermediate portion extending between the first end and the second end; wherein said second portion is a second substantially straight segment; and wherein said second substantially straight segment extends perpendicularly outwardly from the intermediate portion of said first substantially straight segment.

4. The load conductor of claim 3 wherein said number of protrusions is a first T-shaped protrusion and a second T-shaped protrusion; wherein said number of recesses of the housing is a first recess and a second recess; wherein said first T-shaped protrusion is structured to be substantially disposed within said first recess; and wherein said second T-shaped protrusion is structured to be substantially disposed within said second recess.

5. The load conductor of claim 4 wherein the housing further comprises a first channel extending outwardly from said first recess and a second channel extending outwardly from said second recess; wherein said first substantially straight segment of said first T-shaped protrusion is structured to be disposed in said first recess; wherein said second substantially straight segment of said first T-shaped protrusion is structured to be disposed in said first channel; wherein said first substantially straight segment of said second T-shaped protrusion is structured to be disposed in said second recess; and wherein said second substantially straight segment of said second T-shaped protrusion is structured to be disposed in said second channel.

6. The load conductor of claim 4 wherein each of said first substantially straight segments and said second substantially straight segments has a longitudinal axis; wherein the longitudinal axis of said first substantially straight segment of said first T-shaped protrusion is aligned with the longitudinal axis of said first substantially straight segment of said second T-shaped protrusion; and wherein the longitudinal axis of said second substantially straight segment of said first T-shaped protrusion is parallel to the longitudinal axis of said second substantially straight segment of said second T-shaped protrusion.

7. The load conductor of claim 3 wherein the second side of said load conductor includes a projection; wherein said projection projects generally perpendicularly outwardly from the second side of said load conductor; wherein said projection comprises a first side and a second side disposed opposite the first side of said projection; and wherein said second substantially straight segment extends outwardly from the first side of said projection between the first side of said projection and said second substantially straight segment.

8. The load conductor of claim 7 wherein said projection further comprise a first edge and a second edge disposed opposite and distal from the first edge; wherein the second side of said load conductor comprises a circular perimeter; wherein said projection extends laterally across the second side of said load conductor; wherein the first edge of said projection extends beyond the circular perimeter of said load conductor in a first direction; wherein the second edge of said projection extends beyond the circular perimeter of said load conductor in a second direction opposite the first direction; and wherein said protrusions do not extend beyond the circular perimeter of said load conductor.

9. The load conductor of claim 8 wherein said first substantially straight segment is a substantially rectangular segment; wherein said substantially rectangular segment includes a plurality of corners; and wherein a corresponding one of said corners is contiguous with the circular perimeter of said load conductor.

10. The load conductor of claim 1 wherein said number of protrusions is a plurality of protrusions; and wherein all of said protrusions is substantially identical.

11. An electrical switching apparatus comprising:
- a housing comprising a number of recesses; and at least one load conductor comprising:

a first side, a second side disposed opposite and distal from the first side, an intermediate portion extending between the first side and the second side, and a number of protrusions extending outwardly from the second side, each of said protrusions being disposed within a corresponding one of said recesses of the housing to secure said at least one load conductor without a separate fastener.

12. The electrical switching apparatus of claim 11 wherein each of said protrusions of said at least one load conductor comprises a first substantially straight segment and a second substantially straight segment; wherein said first substantially straight segment includes a first end, a second end disposed opposite and distal from the first end, and an intermediate portion extending between the first end and the second end; and wherein said second substantially straight segment extends perpendicularly outwardly from the intermediate portion of said first substantially straight segment.

13. The electrical switching apparatus of claim 12 wherein said number of protrusions of said at least one load conductor is a first T-shaped protrusion and a second T-shaped protrusion; wherein said number of recesses of the housing is a first recess and a second recess; wherein said first T-shaped protrusion is substantially disposed within said first recess; and wherein said second T-shaped protrusion is substantially disposed within said second recess.

14. The electrical switching apparatus of claim 13 wherein the housing further comprises a first channel extending outwardly from said first recess and a second channel extending outwardly from said second recess; wherein said first substantially straight segment of said first T-shaped protrusion is disposed in said first recess; wherein said second substantially straight segment of said first T-shaped protrusion is disposed in said first channel; wherein said first substantially straight segment of said second T-shaped protrusion is disposed in said second recess; and wherein said second substantially straight segment of said second T-shaped protrusion is disposed in said second channel.

15. The electrical switching apparatus of claim 13 wherein each of said first substantially straight segments and said second substantially straight segments has a longitudinal axis; wherein the longitudinal axis of said first substantially straight segment of said first T-shaped protrusion is aligned with the longitudinal axis of said first substantially straight segment of said second T-shaped protrusion; and wherein the longitudinal axis of said second substantially straight segment of said first T-shaped protrusion is parallel to the longitudinal axis of said second substantially straight segment of said second T-shaped protrusion.

16. The electrical switching apparatus of claim 12 wherein the second side of said at least one load conductor includes a projection; wherein said projection projects generally perpendicularly outwardly from the second side of said load conductor; wherein said projection comprises a first side and a second side disposed opposite the first side of said projection; and wherein said second substantially straight segment extends outwardly from the first side of said projection between the first side of said projection and said second substantially straight segment.

17. The electrical switching apparatus of claim 16 wherein said projection further comprise a first edge and a second edge disposed opposite and distal from the first edge; wherein the second side of said load conductor comprises a circular perimeter; wherein said projection extends laterally across the second side of said load conductor; wherein the first edge of said projection extends beyond the circular perimeter of said load conductor in a first direction; wherein the second edge of said projection extends beyond the circular perimeter of said load conductor in a second direction opposite the first direction; wherein said first substantially straight segment is a substantially rectangular segment; wherein said substantially rectangular segment includes a plurality of corners; and wherein a corresponding one of said corners is contiguous with the circular perimeter of said load conductor.

18. The electrical switching apparatus of claim 11 wherein said number of protrusions of said at least one load conductor is a plurality of protrusions; and wherein all of said protrusions is substantially identical.

19. The electrical switching apparatus of claim 11 wherein said electrical switching apparatus is a circuit breaker; wherein said circuit breaker includes a plurality of poles; and wherein said at least one load conductor is a plurality of load conductors, one for each pole of said circuit breaker.

20. The electrical switching apparatus of claim 19 wherein each of said plurality of load conductors includes a first protrusion and a second protrusion; wherein said number of recesses of the housing of said circuit breaker is a pair of recesses for each pole of said circuit breaker; wherein each pair of recesses includes a first recess and a second recess; wherein said first protrusion of each of said load conductors is disposed within a corresponding one of said first recesses; and wherein said second protrusion of each of said load conductors is disposed within a corresponding one of said second recesses.

* * * * *